US012084783B2

(12) United States Patent
Tsuji

(10) Patent No.: US 12,084,783 B2
(45) Date of Patent: Sep. 10, 2024

(54) PLATING APPARATUS AND RINSE PROCESS METHOD

(71) Applicant: EBARA CORPORATION, Tokyo (JP)

(72) Inventor: Kazuhito Tsuji, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 0 days.

(21) Appl. No.: 17/781,356

(22) PCT Filed: Sep. 10, 2021

(86) PCT No.: PCT/JP2021/033307
§ 371 (c)(1),
(2) Date: May 31, 2022

(87) PCT Pub. No.: WO2023/037495
PCT Pub. Date: Mar. 16, 2023

(65) Prior Publication Data

US 2024/0183058 A1 Jun. 6, 2024

(51) Int. Cl.
*C25D 21/08* (2006.01)
*C25D 21/10* (2006.01)

(52) U.S. Cl.
CPC ..... *C25D 21/08* (2013.01); *C25D 21/10* (2013.01)

(58) Field of Classification Search
CPC ..... C25D 21/08; C25D 21/10
See application file for complete search history.

(56) References Cited

U.S. PATENT DOCUMENTS

2019/0301049 A1 10/2019 Zimmerman et al.

FOREIGN PATENT DOCUMENTS

| | | | | |
|---|---|---|---|---|
| JP | 2001172798 | A | * | 6/2001 |
| JP | 2003-517201 | A | | 5/2003 |
| JP | 2003-247098 | A | | 9/2003 |
| JP | 2004-183042 | A | | 7/2004 |
| JP | 2004-241433 | A | | 8/2004 |
| JP | 2006070349 | A | * | 3/2006 |
| JP | 2007-332435 | A | | 12/2007 |
| JP | 6934127 | B1 | | 9/2021 |
| KR | 2010-0018724 | A | | 2/2010 |
| WO | WO 2001/45144 | A1 | | 6/2001 |

OTHER PUBLICATIONS

Machine translation of JP-2001172798-A (Year: 2001).*
Machine translation of JP-2006070349-A (Year: 2006).*

* cited by examiner

*Primary Examiner* — Erin F Bergner
(74) *Attorney, Agent, or Firm* — BakerHostetler

(57) ABSTRACT

A plating apparatus 1000 includes a rinse module 40 configured to perform a rinse process. The rinse module includes: a rinse nozzle 41 configured to discharge the rinse solution to a member to be rinsed 25 while the rinse process is performed; a blow nozzle 42 disposed below the rinse nozzle and blowing out a gas such that the gas crosses a space between the plating tank and a substrate holder 20 while the rinse process is performed; and a collection member 50 disposed at downstream of the gas blown out from the blow nozzle and collecting the rinse solution dropping from the member to be rinsed and entrained in a flow of the gas blown out from the blow nozzle.

13 Claims, 11 Drawing Sheets

PLATING APPARATUS AND RINSE PROCESS METHOD

TECHNICAL FIELD

The present invention relates to a plating apparatus and a rinse process method.

BACKGROUND ART

Conventionally, there has been known what is called a cup type plating apparatus as a plating apparatus that can perform plating on a substrate (for example, see PTL 1). Such a plating apparatus includes a plating tank with an anode therein, a substrate holder that is disposed above the anode and holds a substrate as a cathode, a rotation mechanism that rotates the substrate holder, and an elevating mechanism that moves up and down the substrate holder.

In such a plating apparatus, a "rinse process" that rinses a "member to be rinsed" at least one of the substrate and the substrate holder with a rinse solution is performed in some cases (for example, see PTL 1). In relation to this, for example, the plating apparatus according to PTL 1 discharges the rinse solution from a rinse nozzle (referred to as an injection nozzle in PTL 1) disposed above the plating tank to the member to be rinsed to rinse the member to be rinsed.

CITATION LIST

Patent Literature

PTL 1: Japanese Unexamined Patent Application Publication No. 2007-332435

SUMMARY OF INVENTION

Technical Problem

The conventional plating apparatus described as an example in PTL 1 described above has a structure in which all amount of the rinse solution that drops from the member to be rinsed falls into the plating tank, and therefore a large amount of the rinse solution possibly enters into a plating solution in the plating tank. In this case, there is a possibility that the plating solution in the plating tank excessively is diluted by the rinse solution.

The present invention has been made in view of the above, and one of the objects of the present invention is to provide a technique that allows suppressing an entrance of a large amount of a rinse solution into a plating solution in a plating tank.

Solution to Problem (Aspect 1)

In order to achieve the object, a plating apparatus according to one aspect of the present invention includes a plating module. The plating module includes a plating tank, a substrate holder, a rotation mechanism, an elevating mechanism, and a rinse module. An anode is disposed in the plating tank. The substrate holder is disposed above the anode and configured to hold a substrate as a cathode. The rotation mechanism is configured to rotate the substrate holder. The elevating mechanism is configured to move up and down the substrate holder. The rinse module is configured to perform a rinse process rinsing a member to be rinsed as at least one of the substrate and the substrate holder with a rinse solution while the substrate holder is positioned above the plating tank. The rinse module includes a rinse nozzle, a blow nozzle, and a collection member. The rinse nozzle is configured to discharge the rinse solution to the member to be rinsed while the rinse process is performed. The blow nozzle is disposed below the rinse nozzle. The blow nozzle blows out a gas such that the gas crosses a space between the plating tank and the substrate holder while the rinse process is performed. The collection member is disposed at a downstream of the gas blown out from the blow nozzle. The collection member collects the rinse solution dropping from the member to be rinsed and entrained in a flow of the gas blown out from the blow nozzle.

According to the aspect, while the rinse process is performed, the rinse solution is discharged from the rinse nozzle to the member to be rinsed, thus allowing rinsing the member to be rinsed. The rinse solution dropping from the member to be rinsed can be entrained in the flow of the gas blown out from the blow nozzle and collected by the collection member. This allows suppressing an entrance of a large amount of the rinse solution into the plating solution in the plating tank. This allows suppressing excessive dilution of the plating solution in the plating tank by the rinse solution.

(Aspect 2)

In the aspect 1, the rinse nozzle and the blow nozzle may be fixed to an outside of an elevating region as a region in which the substrate holder moves up and down.

(Aspect 3)

In the aspect 1, the rinse module may further include a moving mechanism configured to move the blow nozzle between a first position and a second position. The first position may be outside an elevating region as a region in which the substrate holder moves up and down. The second position may be inside the elevating region.

(Aspect 4)

In the aspect 3, the moving mechanism may be configured to further move the rinse nozzle between the first position and the second position.

(Aspect 5)

In any one of the aspects 1 to 4, the blow nozzle may be a slit nozzle configured to blow out the gas in a film shape.

(Aspect 6)

In any one of the aspects 1 to 4, the blow nozzle may be configured to radially blow out the gas with the blow nozzle as a starting point.

(Aspect 7)

In any one of the aspects 1 to 6, the substrate holder may be horizontal while the rinse process is performed.

(Aspect 8)

In any one of the aspects 1 to 6, the plating module may further include an inclination mechanism configured to incline the substrate holder with respect to a horizontal direction. The substrate holder may be inclined while the rinse process is performed.

(Aspect 9)

In any one of the aspects 1 to 8, a timing at which the rinse nozzle starts discharging the rinse solution may be earlier than a timing at which the blow nozzle starts blowing out the gas.

(Aspect 10)

In any one of the aspects 1 to 9, the plating module may further include a housing and an exhaust mechanism. The housing may internally house at least the plating tank, the substrate holder, the rotation mechanism, the elevating mechanism, and the rinse module. The exhaust mechanism may discharge an air inside the housing to outside the housing.

(Aspect 11)

In the aspect 10, the exhaust mechanism may be configured to set an exhaust flow rate in a period during which the blow nozzle blows out the gas to be higher than an exhaust flow rate at a time point before the blow nozzle starts blowing out the gas.

(Aspect 12)

In the aspect 10 or 11, an amount of water vapor contained in the gas blown out from the blow nozzle may be equal to or more than an amount of water vapor contained in the air inside the housing.

(Aspect 13)

In order to achieve the object, a rinse process method according to one aspect of the present invention is a rinse process method using the plating apparatus according to any one of the aspects 1 to 12. The rinse process method includes: a first step of discharging the rinse solution from the rinse nozzle to the member to be rinsed while the substrate holder is positioned above the plating tank; and a second step of blowing out the gas from the blow nozzle while the rinse solution is discharged from the rinse nozzle, and collecting the rinse solution dropping from the member to be rinsed and entrained in the flow of the gas blown out from the blow nozzle by the collection member.

According to the aspect, the entrance of a large amount of the rinse solution into the plating solution in the plating tank can be suppressed. This allows suppressing excessive dilution of the plating solution in the plating tank by the rinse solution.

DESCRIPTION OF EMBODIMENTS

The following will describe embodiments of the present invention with reference to the drawings. The drawings are schematically illustrated for ease of understanding features of the embodiments, and, for example, a dimensional ratio of each component is not always identical to that of an actual component. For some drawings, X-Y-Z orthogonal coordinates are illustrated for reference purposes. Of the orthogonal coordinates, the Z-direction corresponds to the upper side, and the −Z-direction corresponds to the lower side (the direction where gravity acts).

Figure 1:
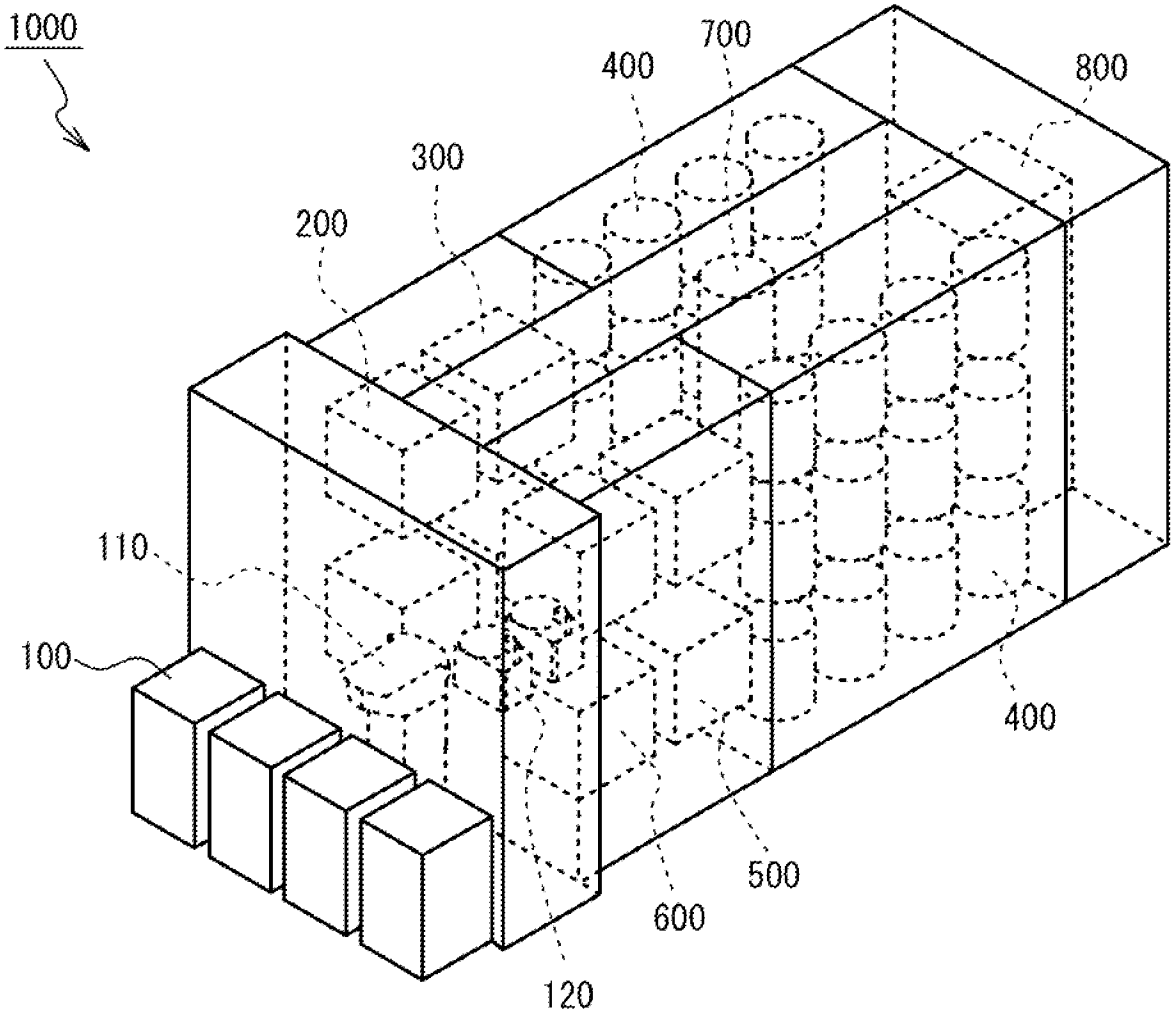
FIG. 1 is a perspective view illustrating an overall configuration of a plating apparatus according to an embodiment.
Figure 2:
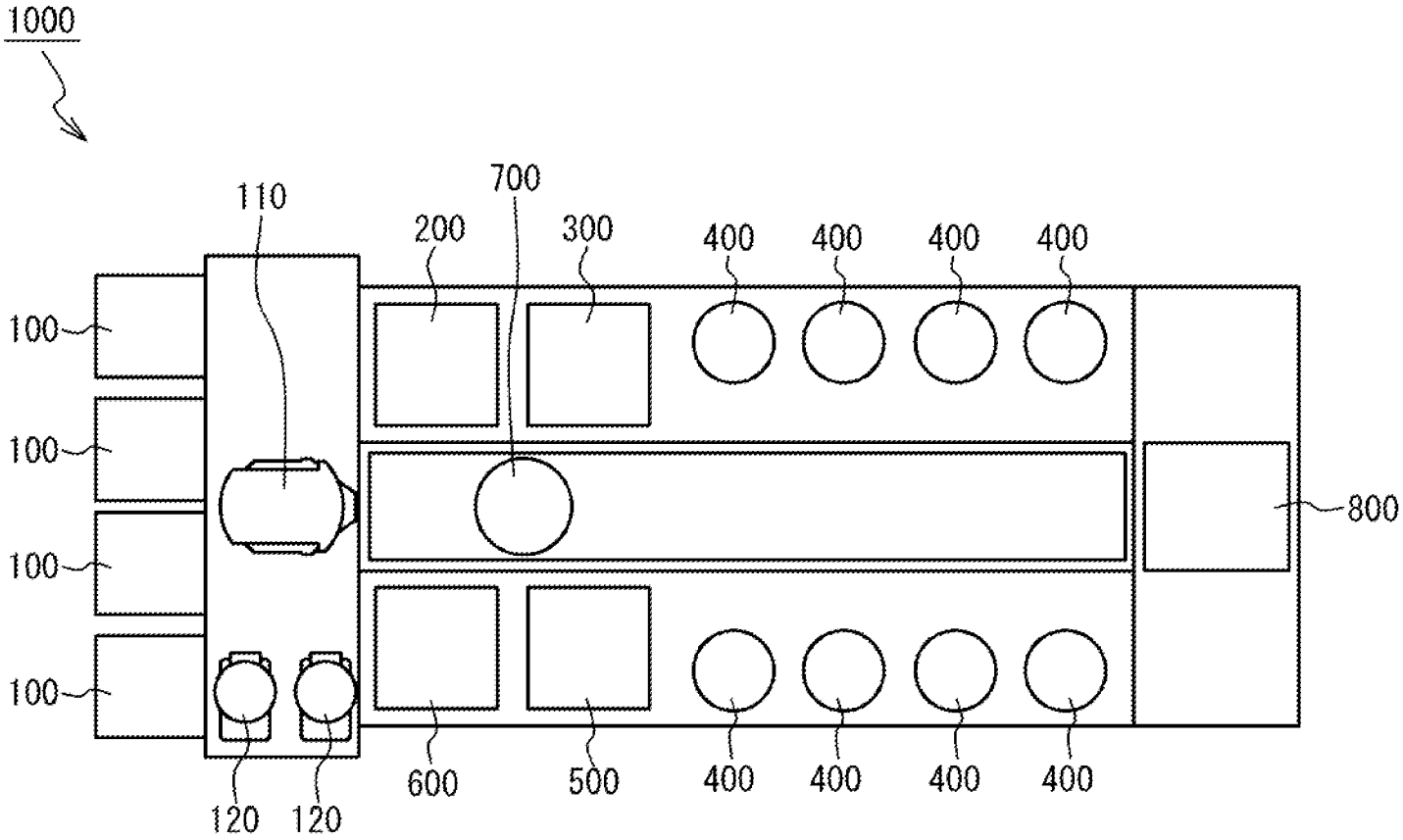
FIG. 2 is a fop view illustrating the overall configuration of the plating apparatus according to the embodiment.

FIG. 1 is a perspective view illustrating an overall configuration of a plating apparatus 1000 of this embodiment. FIG. 2 is a top view illustrating the overall configuration of the plating apparatus 1000 of this embodiment. As illustrated in FIGS. 1 and 2, the plating apparatus 1000 includes load ports 100, a transfer robot 110, aligners 120, pre-wet modules 200, pre-soak modules 300, plating modules 400, cleaning modules 500, spin rinse dryers 600, a transfer device 700, and a control module 800.

The load port 100 is a module for loading a substrate housed in a cassette, such as a FOUP, (not illustrated) to the plating apparatus 1000 and unloading the substrate from the plating apparatus 1000 to the cassette. While the four load ports 100 are arranged in the horizontal direction in this embodiment, the number of load ports 100 and arrangement of the load ports 100 are arbitrary. The transfer robot 110 is a robot for transferring the substrate that is configured to grip or release the substrate between the load port 100, the aligner 120, and the transfer device 700. The transfer robot 110 and the transfer device 700 can perform delivery and receipt of the substrate via a temporary placement table (not illustrated) to grip or release the substrate between the transfer robot 110 and the transfer device 700.

The aligner 120 is a module for adjusting a position of an orientation flat, a notch, and the like of the substrate in a predetermined direction. While the two aligners 120 are disposed to be arranged in the horizontal direction in this embodiment, the number of aligners 120 and arrangement of the aligners 120 are arbitrary. The pre-wet module 200 wets a surface to be plated of the substrate before a plating process with a process liquid, such as pure water or deaerated water, to replace air inside a pattern formed on the surface of the substrate with the process liquid. The pre-wet module 200 is configured to perform a pre-wet process to facilitate supplying the plating solution to the inside of the pattern by replacing the process liquid inside the pattern with a plating solution during plating. While the two pre-wet modules 200 are disposed to be arranged in the vertical direction in this embodiment, the number of pre-wet modules 200 and arrangement of the pre-wet modules 200 are arbitrary.

For example, the pre-soak module 300 is configured to remove an oxidized film having a large electrical resistance present on, a surface of a seed layer formed on the surface to be plated of the substrate before the plating process by etching with a process liquid, such as sulfuric acid and hydrochloric acid, and perform a pre-soak process that cleans or activates a surface of a plating base layer. While the two pre-soak modules 300 are disposed to be arranged in the vertical direction in this embodiment, the number of pre-soak modules 300 and arrangement of the pre-soak modules 300 are arbitrary. The plating module 400 performs the plating process on the substrate. There are two sets of the 12 plating modules 400 arranged by three in the vertical direction and by four in the horizontal direction, and the total 24 plating modules 400 are disposed in this embodiment, but the number of plating modules 400 and arrangement of the plating modules 400 are arbitrary.

The cleaning module 500 is configured to perform a cleaning process on the substrate to remove the plating solution or the like left on the substrate after the plating process. While the two cleaning modules 500 are disposed to be arranged in the vertical direction in this embodiment, the number of cleaning modules 500 and arrangement of the cleaning modules 500 are arbitrary. The spin rinse dryer 600 is a module for rotating the substrate after the cleaning process at high speed and drying the substrate. While the two spin rinse dryers 600 are disposed to be arranged in the vertical direction in this embodiment, the number of spin rinse dryers 600 and arrangement of the spin rinse dryers 600 are arbitrary. The transfer device 700 is a device for transferring the substrate between the plurality of modules inside the plating apparatus 1000. The control module 800 is configured to control the plurality of modules in the plating apparatus 1000 and can be configured of, for example, a general computer including input/output interfaces with an operator or a dedicated computer.

An example of a sequence of the plating processes by the plating apparatus 1000 will be described. First, the substrate housed in the cassette is loaded on the load port 100. Subsequently, the transfer robot 110 grips the substrate from the cassette at the load port 100 and transfers the substrate to the aligners 120. The aligner 120 adjusts the position of the orientation flat, the notch, or the like of the substrate in the predetermined direction. The transfer robot 110 grips or releases the substrate whose direction is adjusted with the aligners 120 to the transfer device 700.

The transfer device 700 transfers the substrate received from the transfer robot 110 to the pre-wet module 200. The pre-wet module 200 performs the pre-wet process on the substrate. The transfer device 700 transfers the substrate on which the pre-wet process has been performed to the pre-soak module 300. The pre-soak module 300 performs the pre-soak process on the substrate. The transfer device 700 transfers the substrate on which the pre-soak process has been performed to the plating module 400. The plating module 400 performs the plating process on the substrate.

The transfer device 700 transfers the substrate on which the plating process has been performed to the cleaning module 500. The cleaning module 500 performs the cleaning process on the substrate. The transfer device 700 transfers the substrate on which the cleaning process has been performed to the spin rinse dryer 600. The spin rinse dryer 600 performs the drying process on the substrate. The transfer device 700 grips or releases the substrate on which the drying process has been performed to the transfer robot 110. The transfer robot 110 transfers the substrate received from the transfer device 700 to the cassette at the load port 100. Finally, the cassette housing the substrate is unloaded from the load port 100.

Note that the configurations of the plating apparatus 1000 that have been described in FIG. 1 and FIG. 2 are merely examples, and are not limited to the configurations in FIG. 1 and FIG. 2.

Additionally, the plating module 400 according to this embodiment includes a rinse module 40 described later, and a rinse process performed by the rinse module 40 can be in substitution for a cleaning process by the cleaning module 500 described above. Accordingly, the plating apparatus 1000 can have a configuration not including the cleaning modules 500.

Subsequently, the plating module 400 will be described. Since the plurality of plating modules 400 provided with the plating apparatus 1000 according to this embodiment have the similar configurations, only one plating module 400 will be described.

Figure 3:
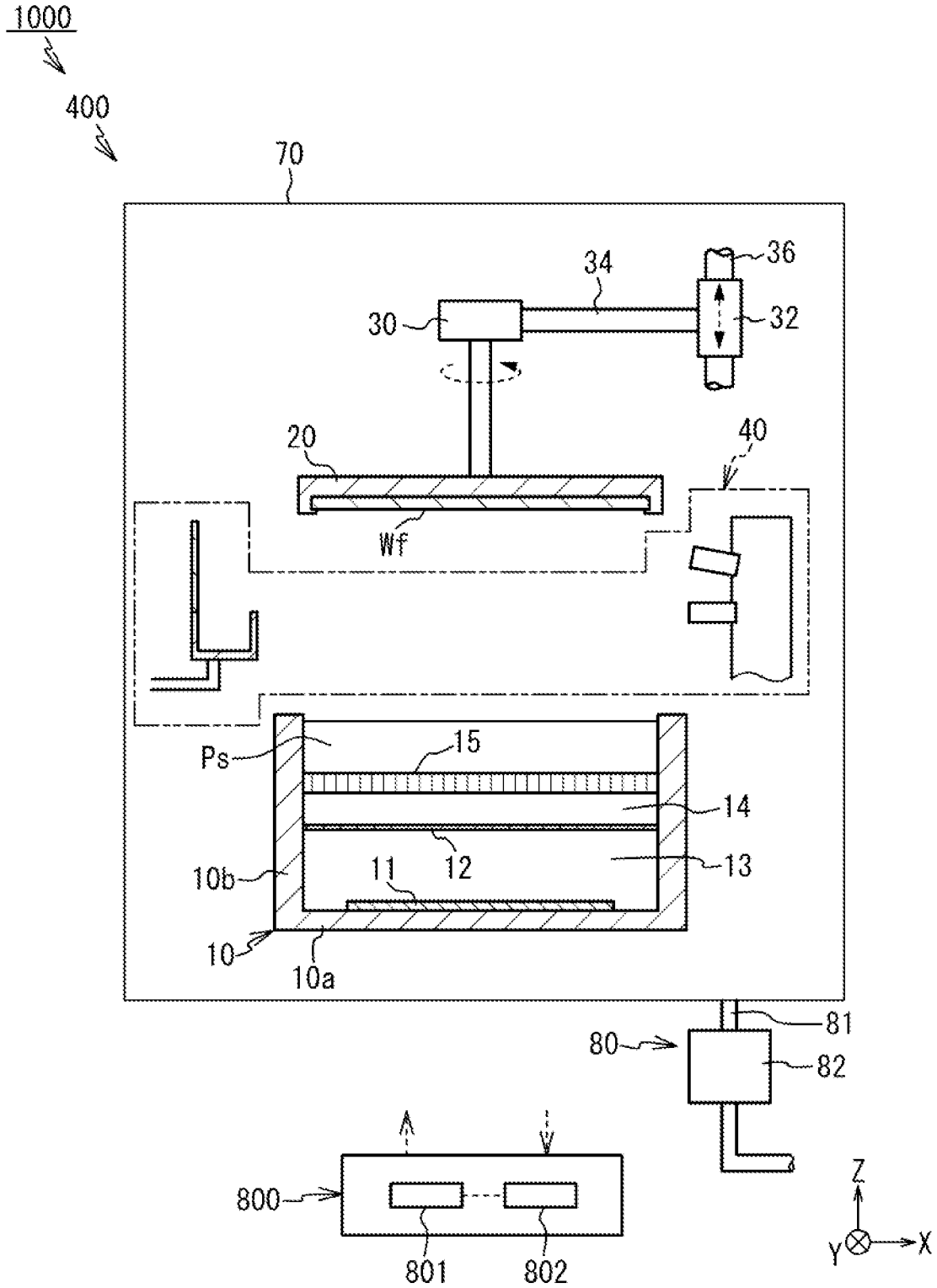
FIG. 3 is a schematic diagram for describing a configuration of a plating module 400 according to the embodiment.

FIG. 3 is a schematic diagram for describing a configuration of the plating module 400 of the plating apparatus 1000 according to this embodiment. The plating apparatus 1000 according to this embodiment is a cup type plating apparatus. The plating module 400 illustrated in FIG. 3 as an example mainly includes a plating tank 10, a substrate holder 20, a rotation mechanism 30, an elevating mechanism 32, an inclination mechanism 34, and the rinse module 40, and also includes a housing 70 that internally houses these components. The plating module 400 further includes an exhaust mechanism 80. Note that FIG. 3 schematically illustrates cross-sectional surfaces of some components.

The plating tank 10 according to this embodiment is configured of a container with a bottom having an opening on an upper side. Specifically, the plating tank 10 has a bottom wall 10*a* and an outer peripheral wall 10*b* extending upward from an outer peripheral edge of the bottom wall 10*a*, and an upper portion of the outer peripheral wall 10*b* is open. Note that, although the shape of the outer peripheral wall 10*b* of the plating tank 10 is not particularly limited, the outer peripheral wall 10*b* according to this embodiment has a cylindrical shape as an example.

In an inside of the plating tank 10, a plating solution Ps is accumulated. It is only necessary for the plating solution Ps to be a solution containing an ion of a metallic element constituting a plating film, and its specific example is not particularly limited. In this embodiment, a copper plating process is used as an example of the plating process, and a copper sulfate solution is used as an example of the plating solution Ps. Note that the plating solution Ps may contain a predetermined additive.

The plating tank 10 internally includes an anode 11. A specific type of the anode 11 is not particularly limited, and a soluble anode or an insoluble anode can be used. In this embodiment, an insoluble anode is used as an example of the anode 11. A specific type of this insoluble anode is not particularly limited, and platinum, iridium oxide, and the like can be used.

Inside the plating tank 10, a membrane 12 is disposed above the anode 11. Specifically, the membrane 12 is disposed in a position between the anode 11 and a substrate Wf. The plating tank 10 is internally split into two parts in the vertical direction by the membrane 12. A region partitioned as a side below the membrane 12 is referred to as an anode chamber 13. A region in a side above the membrane 12 is referred to as a cathode chamber 14. The above-described anode 11 is disposed in the anode chamber 13. The membrane 12 is made of a film that suppresses passing of an additive contained in the plating solution Ps while permitting metal ions to pass through. Although the specific type of the membrane 12 is not particularly limited, for example, an ion exchange membrane can be used.

An ionically resistive element 15 is disposed in the cathode chamber 14. Specifically, the ionically resistive element 15 is constituted of a porous plate member having a plurality of holes (pores) that penetrate the upper surface and the lower surface of the ionically resistive element 15. The ionically resistive element 15 is a member disposed to uniformize an electric field formed between the anode 11 and the substrate Wf. Although the specific material of the ionically resistive element 15 is not particularly limited, as one example, a resin, such as polyetheretherketone, is used in this embodiment. Note that the configuration of the plating module 400 is not limited to this, and, for example, the plating module 400 can be configured without the ionically resistive element 15.

The substrate holder 20 is a member to hold the substrate Wf as the cathode. A lower surface of the substrate Wf is equivalent to the surface to be plated. The substrate holder 20 is connected to the rotation mechanism 30. The rotation mechanism 30 is a mechanism to rotate the substrate holder 20. As the rotation mechanism 30, the known mechanism, such as a rotation motor, can be used. The rotation mechanism 30 is connected to the elevating mechanism 32. The elevating mechanism 32 is supported by a spindle 36 that vertically extends. The elevating mechanism 32 is a mechanism to vertically move up and down the substrate holder 20, the rotation mechanism 30, and the inclination mechanism 34. As the elevating mechanism 32, the known elevating mechanism, such as a linear motion actuator, can be used. The inclination mechanism 34 is a mechanism to incline the substrate holder 20 and the rotation mechanism 30. As the inclination mechanism 34, the known inclination mechanism, such as a piston-cylinder, can be used.

When the plating process is performed, the rotation mechanism 30 rotates the substrate holder 20 while the elevating mechanism 32 moves the substrate holder 20 downward and immerses the substrate Wf in the plating solution Ps in the plating tank 10. Subsequently, an energization device (not illustrated) causes electricity to flow between the anode 11 and the substrate Wf. Accordingly, the plating film is formed on the lower surface of the substrate Wf (that is, the plating process is performed). Note that when the plating process is performed, the inclination mechanism 34 may incline the substrate holder 20 as necessary.

The exhaust mechanism 80 is a mechanism to discharge the air inside the housing 70 to outside the housing 70. Although the specific configuration of the exhaust mechanism 80 is not particularly limited with the mechanism, as one example, the exhaust mechanism 80 according to this embodiment includes an exhaust pipe SI having one end connected to the housing 70 and an exhaust pump 82 connected to the exhaust pipe 81.

Specifically, the end portion on the upstream in the exhaust flow direction of the exhaust pipe 81 according to this embodiment communicates with the inside of the housing 70, and the end portion on the downstream of the exhaust pipe 81 communicates with the outside of the housing 70. More specifically, the end portion on the downstream of the exhaust pipe 81 according to this embodiment is disposed outside the plating apparatus 1000 (outside the housing of the plating apparatus 1000). The exhaust pump 82 operates in response to a command from the control module 800. When the exhaust pump 82 starts the operation, the air inside the housing 70 passes through the exhaust pipe 81 and is discharged to outside the housing 70 (outside the plating apparatus 1000 in this embodiment). This allows setting the inner pressure of the housing 70 to a "negative pressure" lower than the outer pressure of the housing 70. In this embodiment, the negative pressure is specifically a pressure lower than an atmospheric pressure.

Note that a portion other than a portion to which the exhaust mechanism 80 is connected of the housing 70 may be sealed. Alternatively, the housing 70 may have a clearance or an opening in a portion other than the portion to which the exhaust mechanism 80 is connected (that is, the housing 70 need not be sealed). Even in a case where the housing 70 is thus not sealed, the inside of the housing 70 can be the negative pressure with the exhaust mechanism 80.

The control module 800 includes a microcomputer, and this microcomputer includes a Central Processing Unit (CPU) 801 as a processor, a memory 802 as a non-transitory storage medium, and the like. In the control module 800, the CPU 801 controls the operation of the plating module 400 based on commands of a program stored in the memory 802.

Figure 4:
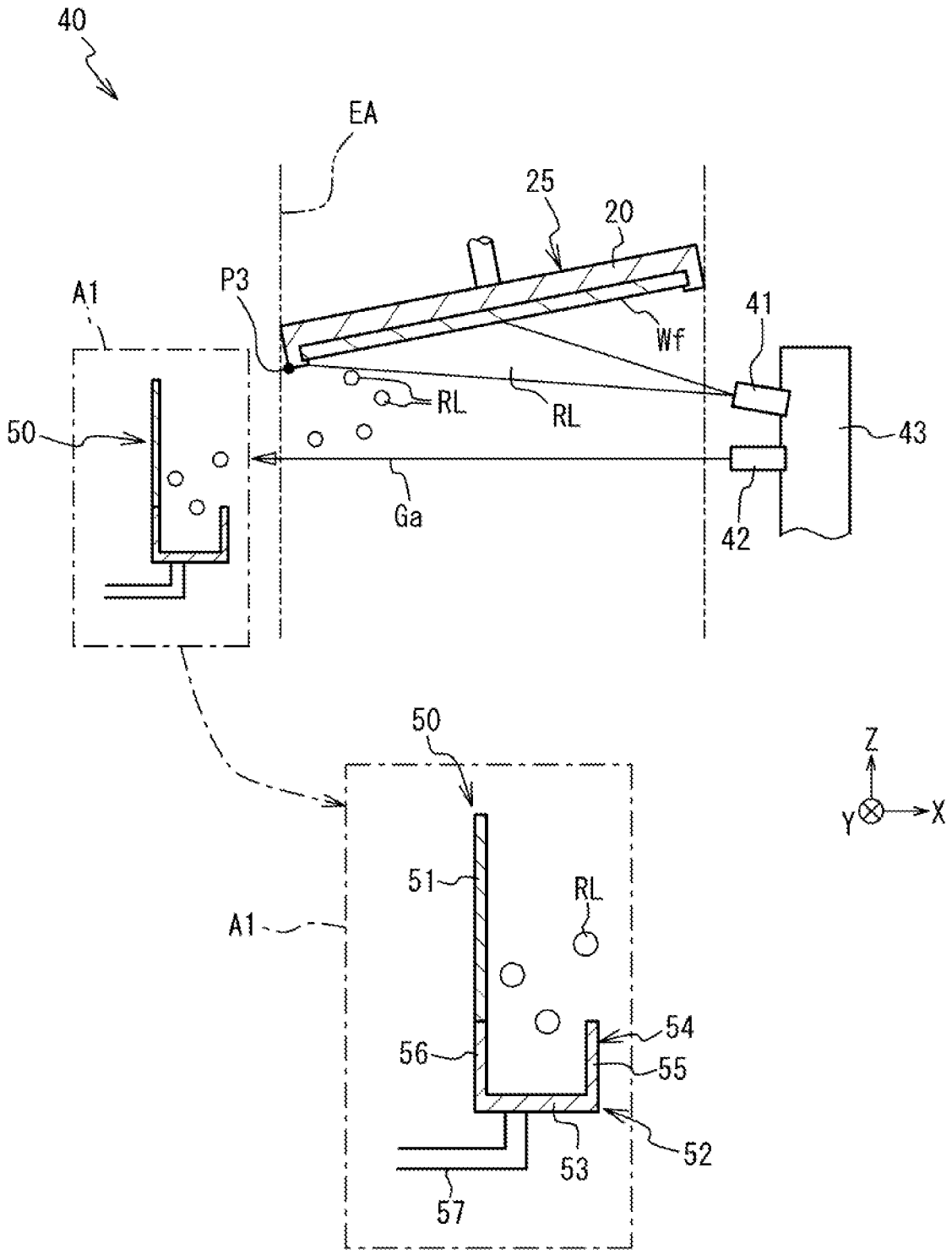
FIG. 4 is a schematic diagram for describing a rinse module according to the embodiment.
Figure 5:
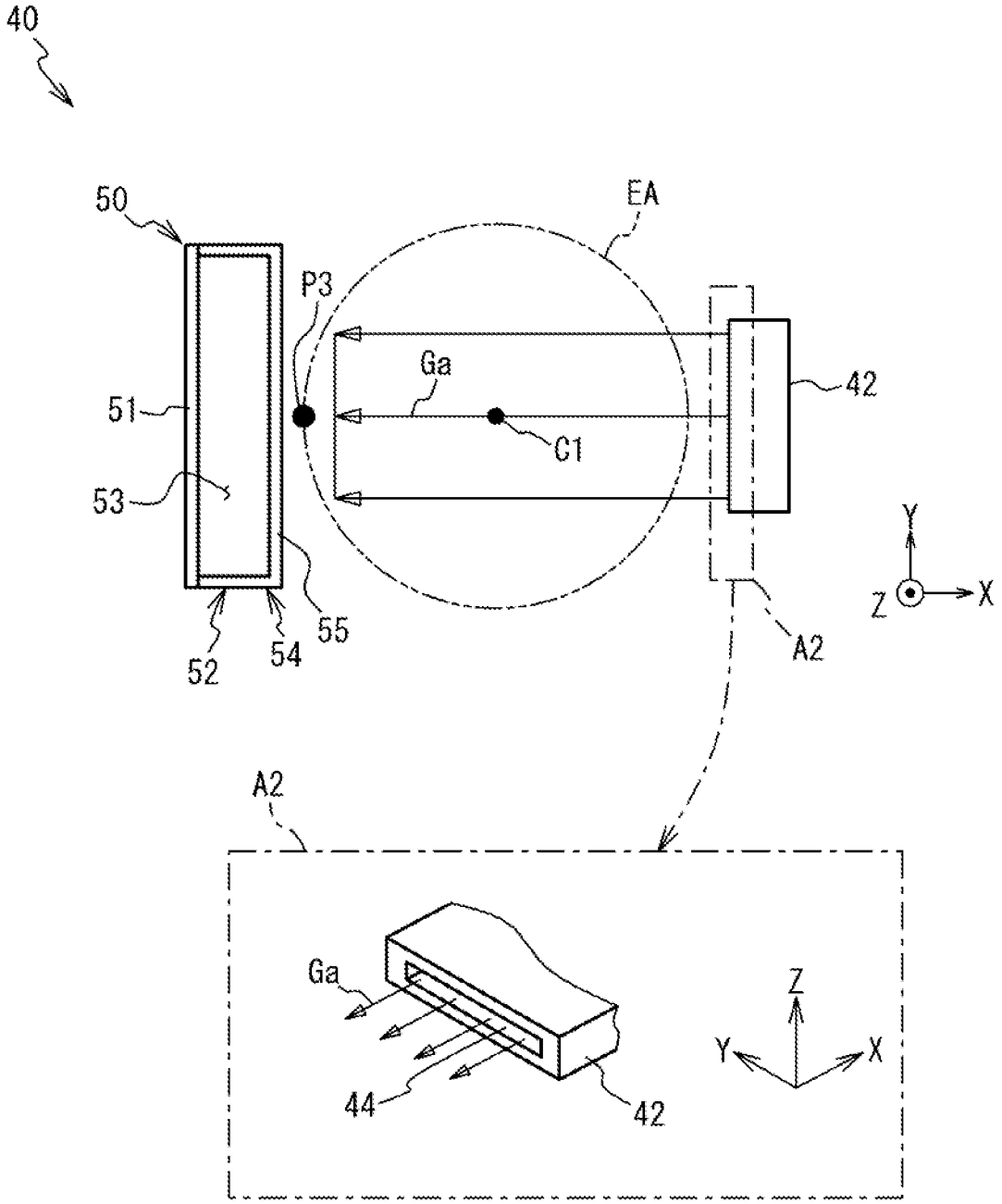
FIG. 5 is a schematic top view of the rinse module according to the embodiment.

Subsequently, the rinse module 40 will be described. FIG. 4 is a schematic diagram for describing the rinse module 40. Specifically, FIG. 4 schematically illustrates a state in which the rinse module 40 performs the rinse process. FIG. 5 is a schematic top view of the rinse module 40. Note that FIG. 5 omits illustration of a rinse nozzle 41 described later. Additionally, a part of FIG. 5 (A2) also illustrates a perspective view of a part at the proximity of a blow-out port 44 of a blow nozzle 42 described later.

The rinse module 40 is a module configured to perform the rinse process on a "member to be rinsed 25" at least one of the substrate Wf and the substrate holder 20. As one example, the member to be rinsed 25 according to this embodiment includes both of the substrate Wf and the substrate holder 20. The rinse process according to this embodiment is specifically a process that rinses the member to be rinsed 25 including the substrate Wf after the plating process with a rinse solution RL.

Although the specific type of the rinse solution RL is not particularly limited, in this embodiment, pure water is used as one example.

With reference to FIG. 4, while the rinse process is performed, the substrate holder 20 is positioned above the plating tank 10. Further, while the rinse process is performed, the substrate holder 20 rotates. Furthermore, while the rinse process is performed, the substrate holder 20 is inclined with respect to the horizontal direction. Specifically, while the rinse process is performed, the substrate holder 20 is inclined such that a surface to be rinsed (a surface to which the rinse solution RL attaches) of the member to be rinsed 25 faces the rinse nozzle 41 described later.

The rinse module 40 includes the rinse nozzle 41, the blow nozzle 42, a supporting member 43, and a collection member 50. The supporting member 43 is a member for supporting the rinse nozzle 41 and the blow nozzle 42. The supporting member 43 is disposed in a region outside an "elevating region EA" as a region in which the substrate holder 20 moves up and down.

While the rinse process is performed, the rinse nozzle 41 discharges the rinse solution RL to the member to be rinsed 25. In this embodiment, as one example of the rinse nozzle 41, a spray liquid discharge nozzle configured to discharge the rinse solution RL in a wide angle is used.

To the rinse nozzle 41, a rinse solution supply device (not illustrated) for supplying the rinse solution RL to the rinse nozzle 41 is connected. The rinse solution supply device includes a reservoir tank that accumulates the rinse solution RL, a pump that pressure-feeds the rinse solution RL in the reservoir tank to the rinse nozzle 41, and the like. The control module 800 controls the discharge operation of the rinse solution RL from the rinse nozzle 41.

While the rinse process is performed, the discharge angle of the rinse nozzle 41 according to this embodiment is adjusted such that the rinse solution RL attaches to the whole lower surface of the rotating substrate Wf. Specifically, the rinse nozzle 41 discharges the rinse solution RL such that the rinse solution RL attaches from the center of the lower surface of the substrate Wf through the outer edge of the lower surface of the substrate Wf. This allows attaching the rinse solution RL to the whole lower surface of the rotating substrate Wf. Additionally, the rinse nozzle 41 causes the rinse solution RL to attach to the part disposed outside the outer edge of the substrate Wf in the substrate holder 20 as well. This allows a part of the substrate holder 20 to be rinsed with the rinse solution RL, in addition to the lower surface of the substrate Wf.

The blow nozzle 42 is disposed below the rinse nozzle 41. While the rinse process is performed, the blow nozzle 42 is configured to blow out a gas Ga such that the gas Ga crosses a space between the plating tank 10 and the substrate holder 20 (that is, a space above the plating tank 10 and below the substrate holder 20). Moreover, as one example, the blow nozzle 42 according to this embodiment blows out the gas Ga in the horizontal direction (the −X-direction).

With reference to FIG. 4 and FIG. 5, in this embodiment, as one example of the blow nozzle 42, a slit nozzle configured to blow out the gas Ga in a film shape is used. Specifically, as illustrated in the perspective view of the part A2 in FIG. 5, the blow nozzle 42 according to this embodiment includes a slit-shaped blow-out port 44 that extends in the horizontal direction (the Y-direction in FIG. 5). By blowing out the gas Ga from the blow-out port 44 in the −X-direction, the blown out gas Ga has the film shape with the Y-direction as the width direction. Note that the slit nozzle as the blow nozzle 42 is a nozzle generally also referred to as an "air knife."

Figure 11:
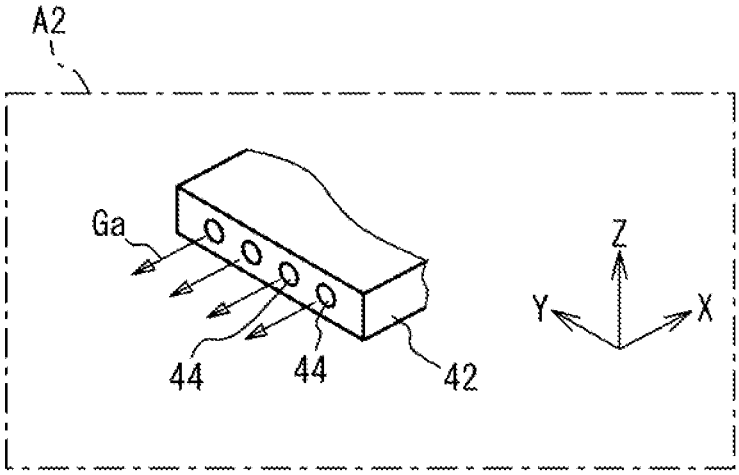
FIG. 11 is a perspective view schematically illustrating another example of blow-out ports in a blow nozzle according to the embodiment.

However, the configuration of the blow nozzle 42 is not limited to the slit nozzle described above. As another example of the blow nozzle 42, as illustrated in FIG. 11 as an example, the blow nozzle 42 may include a plurality of the blow-out ports 44 disposed in a row in the horizontal direction (the Y-direction), and the gas Ga may be blown out from each of the blow-out ports 44.

Additionally, the blow nozzle 42 according to this embodiment blows out the gas Ga such that the gas Ga passes through under a "lowest point P3" positioned at the lowermost of the inclined substrate holder 20. The lowest point P3 is a portion where the rinse solution RL attached to the substrate holder 20 is the most likely to drop from the substrate holder 20. With the configuration, the rinse solution RL dropping from the substrate holder 20 can be effectively entrained in the flow of the gas Ga.

To the blow nozzle 42, a gas supply device (not illustrated) for supplying the gas Ga to the blow nozzle 42 is connected. The gas supply device includes a pump to pressure-feed the gas to the blow nozzle 42 and the like. The control module 800 controls the blow-out operation of the gas Ga from the blow nozzle 42.

Note that the gas Ga according to this embodiment is air as one example. However, the type of the gas Ga is not limited to this, and as another example, an inert gas, such as nitrogen and argon, can be used. In this case, the gas supply device only needs to include, for example, a gas cylinder to accumulate the inert gas.

As illustrated in FIG. 4, the rinse nozzle 41 and the blow nozzle 42 are supported by the supporting member 43, which is disposed outside the elevating region EA. That is, the rinse nozzle 41 and the blow nozzle 42 are fixed to outside the elevating region EA.

With reference to FIG. 4 and FIG. 5, in top view, the rinse nozzle 41 and the blow nozzle 42 are disposed at a portion at the side opposite to the lowest point P3 of the substrate holder 20 between which a center C1 of the substrate holder 20 (this is also the center C1 of the elevating region EA) is interposed.

The collection member 50 is disposed at the downstream of the gas Ga blown out from the blow nozzle 42. The collection member 50 is configured to collect the rinse solution RL that is discharged from the rinse nozzle 41, drops from the member to be rinsed 25 after attaching to the member to be rinsed 25, and is entrained in the flow of the gas Ga.

Specifically, the collection member 50 is disposed to be opposed to the blow nozzle 42 across the elevating region EA. Moreover, with reference to the enlarged view of the part A1 in FIG. 4 and FIG. 5, the collection member 50 includes a cullis member 51, a housing member 52, and a discharge pipe 57.

The cullis member 51 is constituted of a plate member disposed such that the rinse solution RL entrained in the flow of the gas Ga collides with the cullis member 51 and the collided rinse solution RL is guided to the housing member 52. The cullis member 51 according to this embodiment is disposed so as to extend upward from an upper end of a side wall 54 described later (specifically, an outer side wall 56 described later) of the housing member 52.

The housing member 52 is a member configured to temporarily house the rinse solution RL that collides with the cullis member 51, and then runs along the cullis member 51 and drops. Specifically, the housing member 52 according to this embodiment includes a bottom wall 53 and the side wall 54 that extends upward from the outer peripheral edge of the bottom wall 53. The rinse solution RL after collision with the cullis member 51 is temporarily accumulated in an inner region partitioned by the bottom wall 53 and the side wall 54.

Note that among the side walls 54, a side wall at a side close to the center of the substrate holder 20 in the radial direction of the substrate holder 20 is referred to as an "inner side wall 55" and a side wall opposed to the inner side wall 55 and disposed at a side farther from the center of the substrate holder 20 in the radial direction of the substrate holder 20 than the inner side wall 55 is referred to as the "outer side wall 56."

The discharge pipe 57 is connected to the housing member 52. The discharge pipe 57 is a pipe for discharging the rinse solution RL temporarily housed in the housing member 52 to outside. Specifically, the upstream end portion of the discharge pipe 57 according to this embodiment is connected to the housing member 52, and the downstream end portion is connected to a drainage collection tank (not illustrated). The rinse solution RL temporarily housed in the housing member 52 passes through the discharge pipe 57 and is housed in the drainage collection tank. Note that the drainage collection tank according to this embodiment is disposed outside the housing 70 (specifically, outside the plating apparatus 1000), but the arrangement position of the drainage collection tank is not limited to this.

Figure 6:
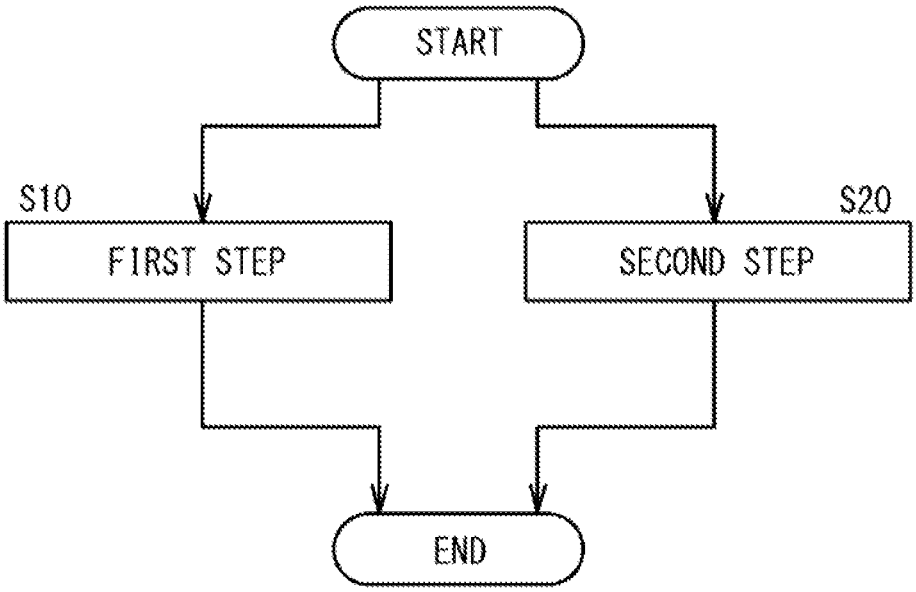
FIG. 6 is an example of a flowchart for describing operations of the plating apparatus during a rinse process according to the embodiment.

FIG. 6 is an example of a flowchart for describing the operations of the plating apparatus 1000 during the rinse process. The control module 800, specifically the CPU 801, performs the flowchart of FIG. 6 based on the command of the program in the memory 802.

The control module 800 starts the flowchart of FIG. 6 when receiving a "rinse process execution start command" as a control command to start the rinse process. When receiving the rinse process execution start command, the control module 800 controls the elevating mechanism 32 such that the substrate holder 20 is positioned above the plating tank 10, controls the inclination mechanism 34 such that the substrate holder 20 is inclined with respect to the horizontal direction, and controls the rotation mechanism 30 such that the substrate holder 20 rotates. Thus, in the state where the substrate holder 20 is positioned above the plating tank 10, is inclined with respect to the horizontal direction, and is rotating. Step S10 and Step S20 described later are performed.

When receiving the rinse process execution start command, the control module 800 starts the operation of the exhaust pump 82 of the exhaust mechanism 80. Thus, while the rinse process is performed (specifically, while Step S10 and Step S20 described later are performed), the inside of the housing 70 can be a negative pressure. This allows suppressing a leakage of, for example, mist and particles containing a chemical substance from the inside to the outside of the housing 70 and attachment of, for example, the mist and particles to the other components of the plating apparatus 1000 (for example, the transfer device 700).

At the first step of Step S10, the control module 800 starts discharging the rinse solution RL from the rinse nozzle 41 to the member to be rinsed 25. Specifically, the control module 800 operates the above-described pump (the pump for pressure-feeding the rinse solution RL to the rinse nozzle 41) to start discharging the rinse solution RL from the rinse nozzle 41.

The control module 800 performs a second step of Step S20 while the rinse solution RL is discharged relative to Step S10. In the second step, the control module 800 starts blowing out the gas Ga from the blow nozzle 42. Specifically, the control module 800 operates the above-described pump (the pump for pressure-feeding the gas Ga to the blow nozzle 42) to start blowing out the gas Ga from the blow nozzle 42.

In the second step, the collection member 50 collects the rinse solution RL dropping from the member to be rinsed 25 and entrained in the flow of the gas Ga. The rinse process is performed through the above-described steps.

According to this embodiment described above, while the rinse process is performed, the rinse solution RL is discharged from the rinse nozzle 41 to the member to be rinsed 25, thus allowing rinsing the member to be rinsed 25. The rinse solution RL dropping from the member to be rinsed 25 can be entrained in the flow of the gas Ga blown out from the blow nozzle 42 and collected by the collection member 50. This allows suppressing the entrance of a large amount of the rinse solution RL into the plating solution Ps in the plating tank 10. This allows suppressing excessive dilution of the plating solution Ps in the plating tank 10 by the rinse solution RL.

Note that although the substrate holder 20 is inclined while the rinse process is performed in this embodiment, the configuration is not limited to this. While the rinse process is performed, the substrate holder 20 is not inclined but may be horizontal. That is, in this case, the rinse process is performed while the lower surface of the substrate Wf held onto the substrate holder 20 is horizontal.

Moreover, the timing at which the rinse nozzle 41 starts discharging the rinse solution RL at Step S10 may be earlier than the timing at which the blow nozzle 42 starts blowing out the gas Ga at Step S20.

With the configuration, the rinse solution RL discharged from the rinse nozzle 41, attaches to the member to be rinsed 25, and then drops from the member to be rinsed 25 before the blow nozzle 42 blows out the gas Ga (that is, the rinse solution RL at the beginning of discharge start) can be returned to the plating tank 10. Thus, the plating solution Ps attached to the member to be rinsed 25 can be returned to the plating tank 10 together with the rinse solution RL. This allows reducing "the amount of plating solution Ps that is not returned to the plating tank 10 but is discarded." On the other hand, after the gas Ga is blown out from the blow nozzle 42, the collection member 50 can collect the rinse solution RL dropping from the member to be rinsed 25. This allows suppressing the entrance of a large amount of the rinse solution RL into the plating solution Ps in the plating tank 10.

Note that in this case, to what extent the discharge start timing of the rinse solution RL is set to be earlier than the blow-out start timing of the gas Ga is preferably determined based on an amount of water vaporized from the plating tank 10. The specific example is as follows.

For example, in a case where the amount of water vaporized from the plating tank 10 is N (L) per hour (namely, N (L/hr)), when the amount of rinse solution RL entering into the plating tank 10 after discharge from the rinse nozzle 41 is N (L/hr) or less, the entrance of a large amount of the rinse solution RL into the plating solution Ps in the plating tank 10 can be suppressed (Note that N is a value larger than zero). Therefore, the discharge start timing of the rinse solution RL only needs to be set such that the discharge start timing of the rinse solution RL becomes earlier than the blow-out start timing of the gas Ga in the range that the amount of rinse solution RL entering into the plating tank 10 after discharge from the rinse nozzle 41 becomes N (L/hr) or less. The preferred discharge start timing of rinse solution RL, for example, only needs to be appropriately determined through experiments, simulations, and the like.

As described above, to set the discharge start timing of the rinse solution RL, in addition to the amount of water vaporized from the plating tank 10, the number of plating processes per hour (time/hr) is preferably further considered. The specific example is, for example, that it is assumed that, using one plating tank 10, the plating process is performed twice per hour (that is, in this case, using one plating tank 10, the plating process is performed on the two substrates Wf per hour). In this case, the discharge start timing of the rinse solution RL only needs to be set such that the discharge start timing of the rinse solution RL becomes earlier than the blow-out start timing of the gas Ga in the range that the total amount of rinse solution RL entering into the plating tank 10 through the two-time plating processes becomes N (L/hr) or less.

Additionally, an exhaust flow rate of the exhaust mechanism 80 in the period during which the blow nozzle 42 blows out the gas Ga (that is, the flow rate ($mm^3$/sec) of air to be discharged) may be higher than the exhaust flow rate ($mm^3$/sec) at the time point before the blow nozzle 42 starts blowing out the gas Ga. Specifically, in this case, it is only necessary that the control module 800 sets a rotational speed (rpm) of the exhaust pump 82 of the exhaust mechanism 80 in the period of the blow nozzle 42 blowing out the gas Ga so as to be larger than the rotational speed (rpm) of the exhaust pump 82 at the time point before the blow nozzle 42 starts blowing out the gas Ga.

With the configuration, in the period of the blow nozzle 42 blowing out the gas Ga, the inside of the housing 70 can effectively become the negative pressure. Accordingly, a leakage of, for example, mist and particles containing a chemical substance from the inside to the outside of the housing 70 can be effectively suppressed.

Additionally, the amount of water vapor ($g/m^3$) contained in the gas Ga blown out from the blow nozzle 42 may be equal to or more than the amount of water vapor ($g/m^3$) contained in the air inside the housing 70. Specifically, in this case, for example, a humidifier is added to the gas supply device for supplying the blow nozzle 42 with the gas Ga, and the gas Ga via the humidifier is blown out from the blow nozzle 42. Thus, the amount of water vapor contained in the gas Ga blown out from the blow nozzle 42 can be larger than the amount of water vapor contained in the air inside the housing 70.

The configuration allows the member to be rinsed 25 to be less likely to be dried compared with the case, for example, where the amount of water vapor contained in the gas Ga blown out from the blow nozzle 42 is smaller than the amount of water vapor contained in the air inside the housing 70.

Subsequently, modifications of the above-described embodiments will be described. Note that in the following descriptions of modifications, the identical reference minerals are given to the configurations identical to or corresponding to those of the embodiment described above and the description thereof will be appropriately omitted in some cases.

(Modification 1)

Figure 7:
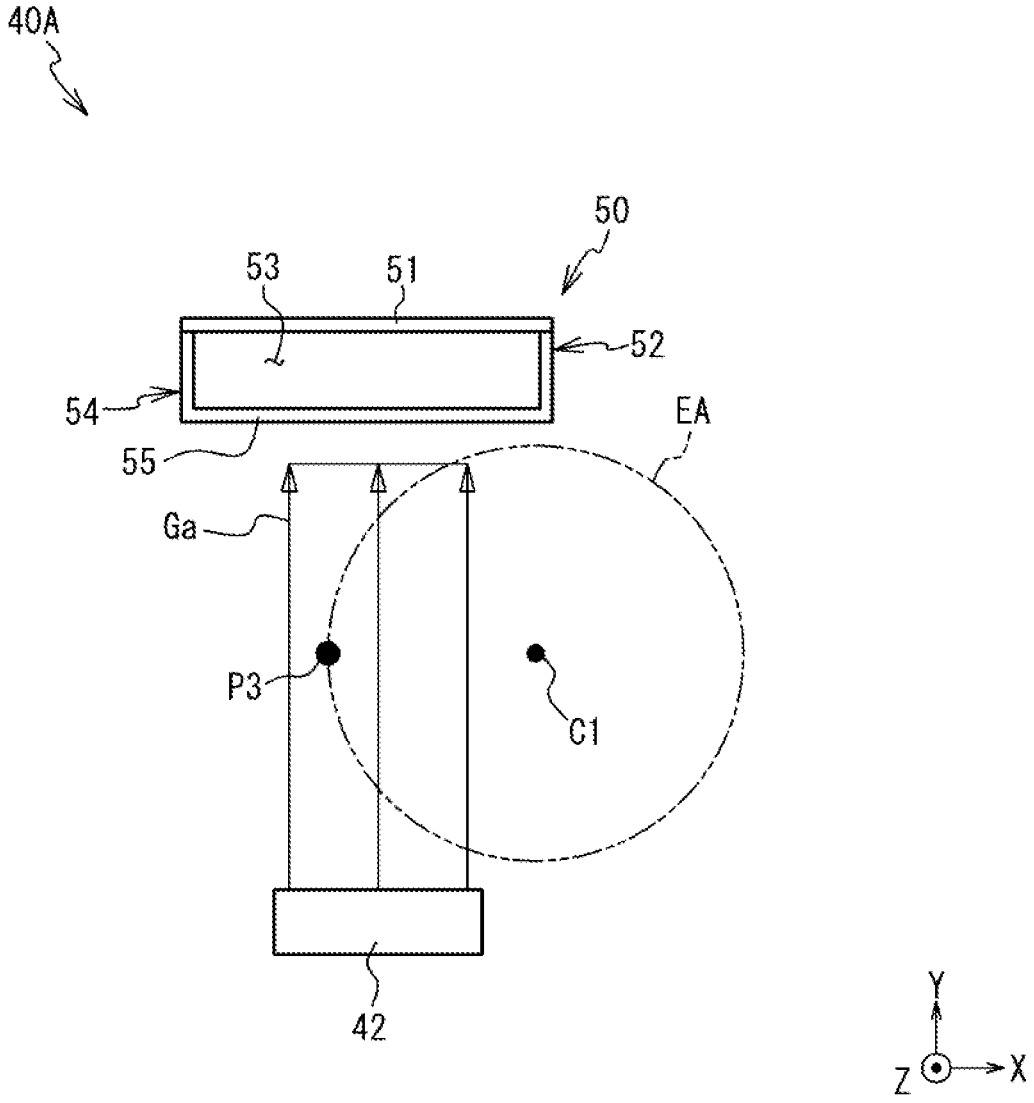
FIG. 7 is a schematic top view of a rinse module according to Modification 1 of the embodiment.

FIG. 7 is a schematic top view of a rinse module 40A according to Modification 1 of the embodiment. Note that FIG. 7 omits the illustration of the rinse nozzle 41. In top view, in the rinse module 40A according to this modification, the blow nozzle 42 is disposed at the side closer to the lowest point P3 of the inclined substrate holder 20 than the center C1 of the substrate holder 20 (the center C1 of the elevating region EA). That is, the blow nozzle 42 according to this modification is disposed at a portion at the proximity of the lowest point P3 of the inclined substrate holder 20. In this respect, the rinse module 40A according to this modification differs from the above-described rinse module 40 illustrated in FIG. 5.

This modification can also provide operational advantages similarly to those of the above-described embodiment.

(Modification 2)

Figure 8:
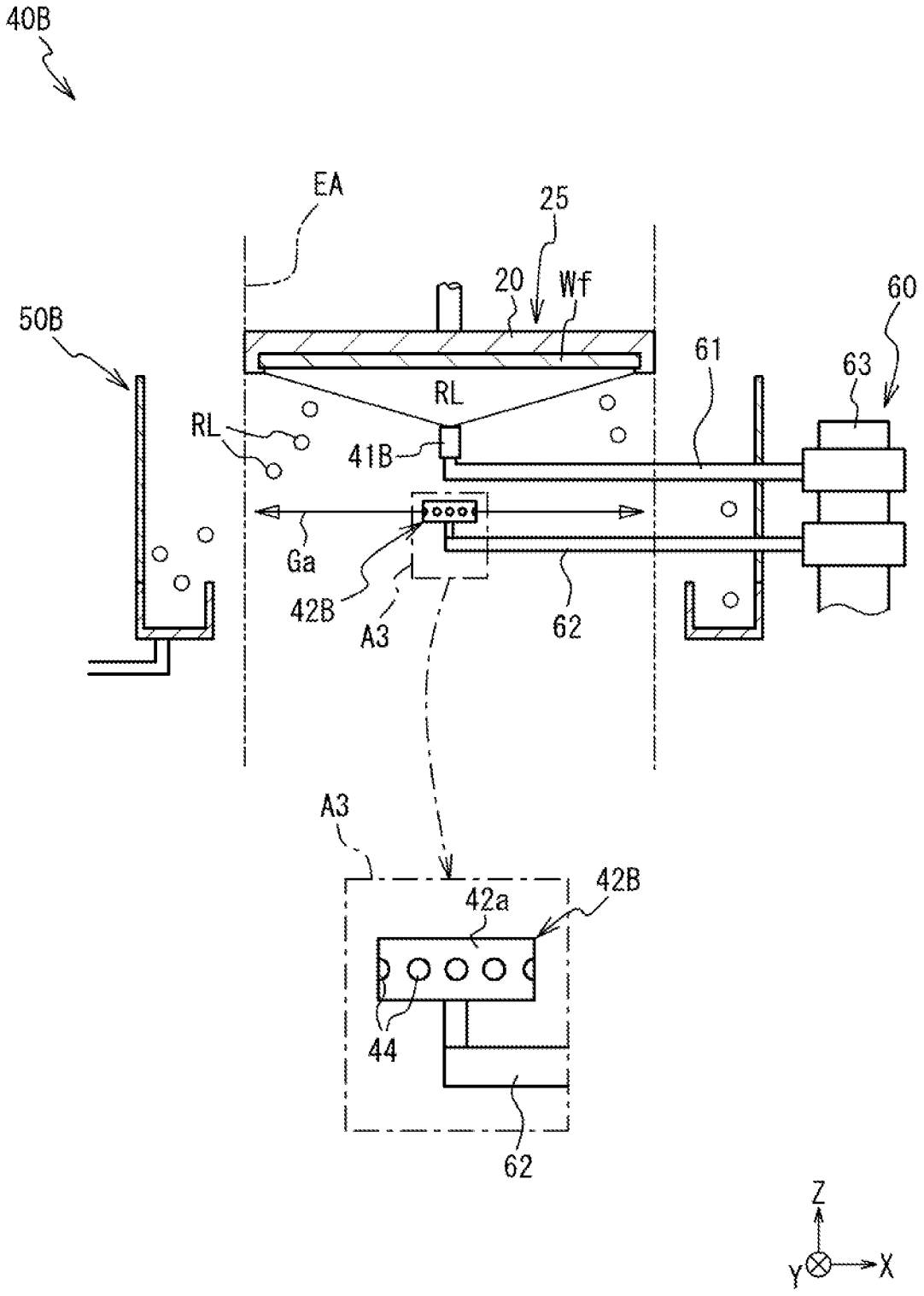
FIG. 8 is a schematic diagram for describing a rinse module according to Modification 2 of the embodiment.

FIG. 8 is a schematic diagram for describing a rinse module 40B according to Modification 2 of the embodiment. Specifically, FIG. 8 schematically illustrates a state in which the rinse module 40B according to this modification performs the rinse process. The rinse module 40B according to this modification differs from the above-described rinse module 40 illustrated in FIG. 4 in that the rinse module 40B further includes a moving mechanism 60, includes a rinse nozzle 41B instead of the rinse nozzle 41, includes a blow nozzle 42B instead of the blow nozzle 42, and includes a collection member 50B instead of the collection member 50.

Figure 9:
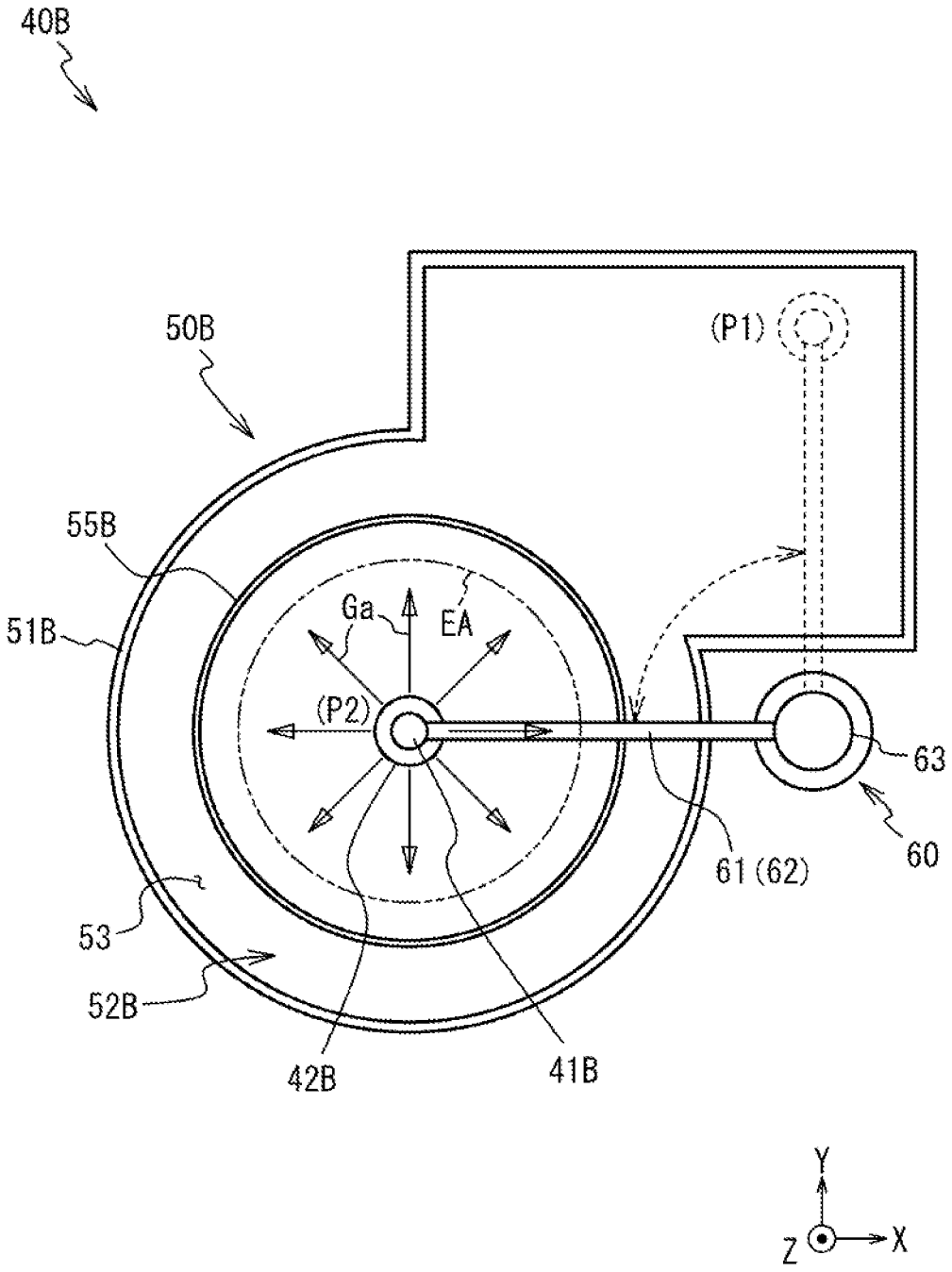
FIG. 9 is a schematic top view of the rinse module according to Modification 2 of the embodiment.

FIG. 9 is a schematic top view of the rinse module 40B according to this modification. With reference to FIG. 8 and FIG. 9, the moving mechanism 60 is configured to move the rinse nozzle 41B and the blow nozzle 42B between a "first position P1" outside the elevating region EA and a "second position P2" inside the elevating region EA.

Specifically, the moving mechanism 60 includes an arm 61, an arm 62, and a rotation shaft 63. The arm 61 has one end connected to the rinse nozzle 41B and the other end connected to the rotation shaft 63. The arm 62 has one end connected to the blow nozzle 42B and the other end connected to a portion lower than the portion to which the arm 61 is connected in the rotation shaft 63.

The rotation shaft 63 is the rotation shaft of the arm 61 and the arm 62 and disposed outside the elevating region EA. The rotation shaft 63 extends in an up-down direction (a vertical direction). The rotation shaft 63 is connected to an actuator (not illustrated), such as a rotation motor, and is rotatably driven by the actuator. The control module 800 controls the operation of the actuator.

The rinse module 40B according to this modification is controlled by the control module 800 to perform the rinse process while the rinse nozzle 41B and the blow nozzle 42B are positioned at the second position P2. Specifically, when receiving the above-described rinse process execution start command, the control module 800 according to this modification rotates the rotation shaft 63 to position the rinse nozzle 41B and the blow nozzle 42B at the second position P2. Thus, with the rinse nozzle 41B and the blow nozzle 42B positioned at the second position P2, the discharge of the rinse solution RL from the rinse nozzle 41B and the blow-out of the gas Ga from the blow nozzle 42B start.

On the other hand, before performing the rinse process or after performing the rinse process, the rinse module 40B moves the rinse nozzle 41B and the blow nozzle 42B to the first position P1. Specifically, before receiving the rinse process execution start command (before performing the rinse process) or when receiving an execution termination command of rinse process (after performing the rinse process), the control module 800 rotates the rotation shaft 63 to return the rinse nozzle 41B and the blow nozzle 42B to the first position P1. That is, the first position P1 can also be referred to as a retracted position.

By thus moving the rinse nozzle 41B and the blow nozzle 42B to the first position P1 before performing the rinse process or after performing the rinse process, the entrance of the rinse nozzle 41B and the blow nozzle 42B into the elevating region EA of the substrate holder 20 when the rinse process is not performed can be suppressed.

As illustrated in FIG. 8, the rinse nozzle 41B positioned at the second position P2 is positioned below the member to be rinsed 25. As one example of this, the rinse nozzle 41B according to this modification at the second position P2 is positioned below the center C1 of the substrate holder 20. The rinse nozzle 41B at the second position P2 discharges the rinse solution RL to the member to be rinsed 25 above the rinse nozzle 41B.

The blow nozzle 42B according to this modification positioned at the second position P2 is also positioned below the member to be rinsed 25. As one example of this, the blow nozzle 42B according to this modification at the second position P2 is positioned below the center C1 of the substrate holder 20.

As illustrated in FIG. 8 and FIG. 9, in top view, the blow nozzle 42B radially blows out the gas Ga with the blow nozzle 42B as the starting point. Specifically, as illustrated in the enlarged view of the part A3 in FIG. 8, the blow nozzle 42B according to this modification has a columnar-shaped appearance. A plurality of the blow-out ports 44 of the blow nozzle 42B are circumferentially arrayed in an outer peripheral surface 42*a* of the columnar blow nozzle 42B. With the configuration, the gas Ga is radially blown out from the plurality of blow-out ports 44 of the blow nozzle 42B.

As illustrated in FIG. 9, in top view, the collection member 50B according to this modification is disposed so as to entirely cover the outer periphery of the elevating region EA. Specifically, an inner side wall 55B of a housing member 52B of the collection member 50B entirely covers the outer periphery of the elevating region EA in top view. Additionally, in top view, a cullis member 51B of the collection member 50B is disposed outside the inner side wall 55B in the radial direction of the substrate holder 20 and entirely covers the outer periphery of the inner side wall 55B.

Note that in a part of the cullis member 51B according to this modification, a groove hole (a groove-shaped hole) that the arm 61 penetrates and a groove hole that the arm 62 penetrates are disposed. Accordingly, when the rinse nozzle 41B and the blow nozzle 42B move between the first position P1 and the second position P2, contact of the arm 61 and the an 62 with the cullis member 51B is suppressed.

However, the configuration is not limited to the above-described configuration. For example, the arm 62 may be disposed so as to pass through below the collection member 50B (specifically, below the bottom wall 53 of the collection member 50B). In this case, the cullis member 51B need not include the groove hole for the arm 62 described above.

Similarly to this, the arm 61 may be disposed so as to pass through below the collection member 50B (specifically, below the bottom wall 53). In this case, the cullis member 51B need not include the groove hole for the arm 61 described above.

Additionally, with reference to FIG. 9, not only the housing member 52B of the collection member 50B according to this modification being disposed so as to ensure housing the rinse solution RL that drops after the collision with the cullis member 51B, but also the housing member 52B being disposed such that the bottom wall 53 of the housing member 52B is positioned below the rinse nozzle 41B positioned at the first position P1. Accordingly, even when the rinse solution RL drops from the rinse nozzle 41B with the rinse nozzle 41B positioned at the first position P1, the housing member 52B can house the dropped rinse solution RL.

This modification can also provide operational advantages similarly to those of the above-described embodiment. Specifically, discharging the rinse solution RL from the rinse nozzle 41B to the member to be rinsed 25 with the rinse nozzle 41B and the blow nozzle 42B of the rinse module 40B positioned at the second position P2 while the rinse process is performed allows rinsing the member to be rinsed 25. Additionally, the rinse solution RL dropping from the member to be rinsed 25 can be entrained in the flow of the gas Ga blown out from the blow nozzle 42B and collected by the collection member 50B. This allows suppressing the entrance of a large amount of the rinse solution RL into the plating solution Ps in the plating tank 10.

Note that while the rinse process illustrated in FIG. 8 as an example is performed, the substrate holder 20 is not inclined, but the configuration is not limited to this. In this modification as well, while the rinse process is performed, the substrate holder 20 may be inclined with respect to the horizontal direction.

In this modification, while both of the rinse nozzle 41B and the blow nozzle 42B move between the first position P1 and the second position P2, but the configuration is not limited to this. As another example, while the blow nozzle 42B moves between the first position P1 and the second position P2, the rinse nozzle 41B may be fixed to the outside of the elevating region EA without a move as in the rinse nozzle 41 (FIG. 4) according to the embodiment described above.

Alternatively, while the rinse nozzle 41B moves between the first position P1 and the second position P2, the blow nozzle 42B may be fixed to the outside of the elevating region EA without a move as in the blow nozzle 42 (FIG. 4) according to the embodiment described above.

(Modification 3)

Figure 10:
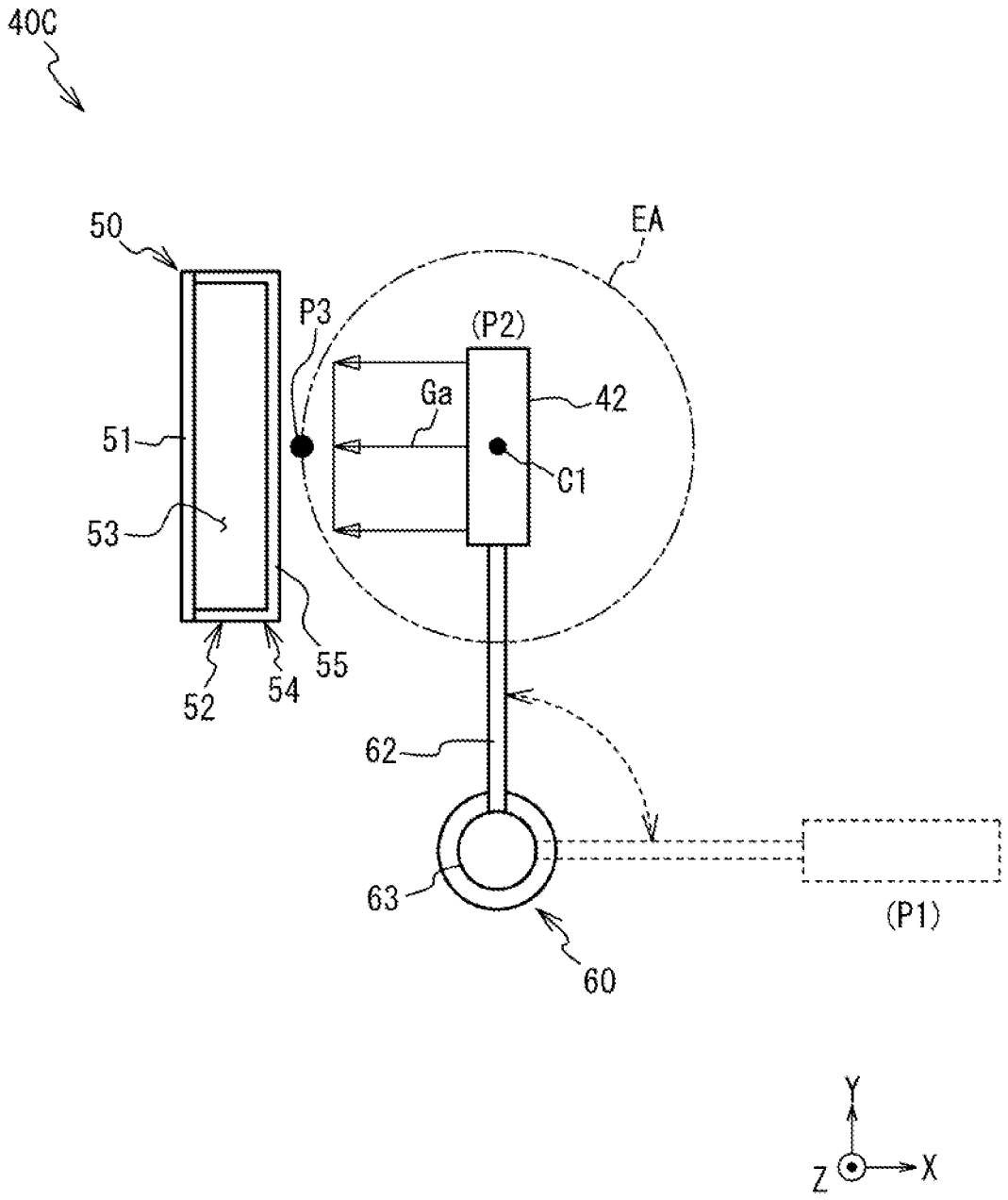
FIG. 10 is a schematic top view of a rinse module according to Modification 3 of the embodiment.

FIG. 10 is a schematic top view of a rinse module 40C according to Modification 3 of the embodiment. The rinse module 40C according to this modification differs from the above-described rinse module 40 illustrated in FIG. 5 as an example in that the blow nozzle 42 is moved between the first position P1 and the second position P2 by the moving mechanism 60.

That is, in this modification, while the rinse nozzle 41 is fixed to the outside of the elevating region EA by the supporting member 43 as illustrated in FIG. 4 as an example described above, as illustrated in FIG. 10 as an example, the blow nozzle 42 moves between the first position P1 and the second position P2.

This modification can also provide operational advantages similarly to those of the above-described embodiment and Modification 2.

Although the embodiment and the modifications according to the present invention have been described in detail above, the present invention is not limited to such specific embodiment and modifications, and various kinds of modifications and changes are possible within the scope of the gist of the present invention described in the claims.

REFERENCE SIGNS LIST

10 . . . plating tank
11 . . . anode
20 . . . substrate holder
30 . . . rotation mechanism
32 . . . elevating mechanism
34 . . . inclination mechanism
40 . . . rinse module
41 . . . rinse nozzle
42 . . . blow nozzle
50 . . . collection member
70 . . . housing
80 . . . exhaust mechanism
400 . . . plating module
1000 . . . plating apparatus
Wf . . . substrate
Ps . . . plating solution
RL . . . rinse solution
Ga . . . gas
EA . . . elevating region
P1 . . . first position
P2 . . . second position

The invention claimed is:

1. A plating apparatus comprising a plating module including:

a plating tank including an anode disposed therein;

a substrate holder disposed above the anode and configured to hold a substrate as a cathode;

a rotation mechanism configured to rotate the substrate holder;

an elevating mechanism configured to move the substrate holder up and down; and a rinse module configured to perform a rinse process rinsing a member to be rinsed as at least one of the substrate and the substrate holder with a rinse solution while the substrate holder is positioned above the plating tank, wherein the rinse module includes:

a rinse nozzle configured to discharge the rinse solution to the member to be rinsed while the rinse process is performed;

a blow nozzle disposed below the rinse nozzle, the blow nozzle configured to blow out a gas such that the gas crosses a space between the plating tank and the substrate holder while the rinse process is performed; and a collection member disposed downstream of the gas blown out from the blow nozzle, the collection member configured to collect the rinse solution dropping from the member to be rinsed and entrained in a flow of the gas blown out from the blow nozzle.

2. The plating apparatus according to claim 1, wherein the rinse nozzle and the blow nozzle are fixed to an outside of an elevating region as a region in which the substrate holder moves up and down.

3. The plating apparatus according to claim 1, wherein the rinse module further includes a moving mechanism configured to move the blow nozzle between a first position and a second position, the first position is outside an elevating region as a region in which the substrate holder moves up and down, and the second position is inside the elevating region.

4. The plating apparatus according to claim 3, wherein the moving mechanism is configured to further move the rinse nozzle between the first position and the second position.

5. The plating apparatus according to claim 1, wherein the blow nozzle is a slit nozzle configured to blow out the gas in a film shape.

6. The plating apparatus according to claim 1, wherein the blow nozzle is configured to radially blow out the gas.

7. The plating apparatus according to claim 1, wherein the substrate holder is configured to be positioned horizontally while the rinse process is performed.

8. The plating apparatus according to claim 1, wherein the plating module further includes an inclination mechanism configured to incline the substrate holder with respect to a horizontal direction, and the substrate holder is inclined while the rinse process is performed.

9. The plating apparatus according to claim 1, further comprising a controller configured to control a timing at which the rinse nozzle starts discharging the rinse solution, wherein the discharge is configure to start earlier than a timing at which the blow nozzle starts blowing out the gas.

10. The plating apparatus according to claim 1, wherein the plating module further includes a housing and an exhaust mechanism, the housing internally houses at least the plating tank, the substrate holder, the rotation mechanism, the elevating mechanism, and the rinse module, and the exhaust mechanism configured to discharge an air inside the housing to outside the housing.

11. The plating apparatus according to claim 10, wherein the exhaust mechanism is configured to set an exhaust flow rate in a period during which the blow nozzle blows out the gas to be higher than an exhaust flow rate at a time point before the blow nozzle starts blowing out the gas.

12. The plating apparatus according to claim 10, wherein the blow nozzle is configured to blow out the gas wherein an amount of water vapor contained in the gas blown out from the blow nozzle is equal to or more than an amount of water vapor contained in the air inside the housing.

13. A rinse process method using the plating apparatus according to claim 1, the rinse process method comprising:

a first step of discharging the rinse solution from the rinse nozzle to the member to be rinsed while the substrate holder is positioned above the plating tank; and a second step of blowing out the gas from the blow nozzle while the rinse solution is discharged from the rinse nozzle, and collecting the rinse solution dropping from the member to be rinsed and entrained in the flow of the gas blown out from the blow nozzle by the collection member.

* * * * *